US007491120B1

(12) United States Patent
Casey Mahon

(10) Patent No.: US 7,491,120 B1
(45) Date of Patent: Feb. 17, 2009

(54) TRICKLE VENT

(75) Inventor: S. A. Casey Mahon, St. Cloud, MN (US)

(73) Assignee: St. Cloud Window Inc., Sauk Rapids, MN (US)

( * ) Notice: Subject to any disclaimer, the term of this patent is extended or adjusted under 35 U.S.C. 154(b) by 473 days.

(21) Appl. No.: 11/191,690

(22) Filed: Jul. 27, 2005

(51) Int. Cl.
*F24F 7/00* (2006.01)
*F24F 13/18* (2006.01)
*E06B 7/03* (2006.01)

(52) U.S. Cl. ..... 454/270; 454/214; 454/222; 454/271; 454/273; 454/274; 454/906

(58) Field of Classification Search ..... 454/48, 454/195, 196, 206, 211, 213, 214, 222, 270, 454/271, 273, 274, 275, 324, 906; 181/224, 181/250, 273
See application file for complete search history.

(56) References Cited

U.S. PATENT DOCUMENTS

| | | | | | |
|---|---|---|---|---|---|
| 68,353 | A | * | 9/1867 | Darling | 454/211 |
| 584,890 | A | * | 6/1897 | Pattison | 454/211 |
| 977,413 | A | | 11/1910 | Matheson | |
| 1,289,856 | A | | 12/1918 | Maxim | |
| 1,511,920 | A | | 10/1924 | Tregillus | |
| 1,655,195 | A | | 1/1928 | Newson | |
| 1,888,711 | A | | 11/1932 | Bourne | |
| 1,922,152 | A | | 8/1933 | Bradbury | |
| 2,117,244 | A | * | 5/1938 | Goehring | 454/195 |
| 2,297,046 | A | * | 9/1942 | Bourne | 181/250 |
| 2,341,113 | A | * | 2/1944 | Nelson | 454/271 |
| 3,396,812 | A | * | 8/1968 | Wilcox et al. | 181/250 |
| 3,690,406 | A | * | 9/1972 | Weiss | 181/227 |
| 3,789,747 | A | * | 2/1974 | Wasserman et al. | 454/186 |
| 3,997,200 | A | | 12/1976 | Brown | |
| 4,362,223 | A | | 12/1982 | Meier | |
| 4,615,411 | A | * | 10/1986 | Breitscheidel et al. | 181/224 |
| 4,727,797 | A | * | 3/1988 | Smith | 454/213 |
| 4,736,677 | A | | 4/1988 | Smith | |
| 4,751,980 | A | | 6/1988 | Devane | |
| 5,096,010 | A | * | 3/1992 | Ojala et al. | 180/68.3 |
| D334,819 | S | | 4/1993 | Cole | |
| D335,358 | S | | 5/1993 | Cole | |
| 5,244,434 | A | * | 9/1993 | Stoney et al. | 454/213 |
| 5,317,112 | A | * | 5/1994 | Lee | 181/250 |
| 5,344,366 | A | * | 9/1994 | Stoney et al. | 454/213 |
| 5,505,659 | A | | 4/1996 | Hamilton | |

(Continued)

FOREIGN PATENT DOCUMENTS

| | | | | |
|---|---|---|---|---|
| JP | 57112630 | A | * | 7/1982 |

*Primary Examiner*—Steven B McAllister
*Assistant Examiner*—Patrick F. O'Reilly, III
(74) *Attorney, Agent, or Firm*—Albert W. Watkins

(57) ABSTRACT

A trickle vent such as might be used in association with commercial windows is formed from PVC tubing in two convoluted paths. One or more expansion chambers are provided at turns or directional changes within the tubing which reduce or eliminate noise transmission through the vent. Where a plurality of expansion chambers are used, each chamber may be of different length to dampen a different portion of the acoustic spectrum. In a preferred embodiment, the expansion chambers are filled with an acoustic-type foam, and the ends are not completely sealed. The tubing preferably bridges two extrusions that form a supporting housing for the vent, and by using two separate extrusions bridged by the tubing, both thermal and acoustic isolation are maintained.

10 Claims, 2 Drawing Sheets

U.S. PATENT DOCUMENTS 5,518,452 A * 5/1996 Stoney et al. ..... 454/213
5,558,574 A * 9/1996 Peak ..... 454/213
5,581,945 A 12/1996 Baumle
5,702,297 A * 12/1997 Anderson et al. ..... 454/213
5,723,828 A * 3/1998 Nakagawa ..... 181/250
5,746,654 A * 5/1998 Peak ..... 454/211
5,769,706 A * 6/1998 Cheek ..... 454/195
5,996,733 A * 12/1999 DeTuncq et al. ..... 181/250
6,048,266 A * 4/2000 Leith ..... 454/273
6,357,186 B1 3/2002 Gould
6,533,657 B2 3/2003 Monson et al.
6,558,247 B1 * 5/2003 Peak ..... 454/213
6,640,926 B2 11/2003 Weinstein
6,648,750 B1 11/2003 Wiseman

* cited by examiner

TRICKLE VENT

BACKGROUND OF THE INVENTION

1. Field of the Invention

This invention pertains generally to ventilation for static structures, and more particularly to a trickle vent such as may be used in association with a window to provide requisite pressure equalization and the like. In a most preferred embodiment, the invention provides the desired ventilation while simultaneously inhibiting acoustic and thermal transmission.

2. Description of the Related Art

Shelter is considered to be a basic necessity, ranking closely in importance to food and water. While man has sought out and obtained shelter since the dawn of time, the actual embodiment of this shelter has changed over time to better fit the needs of a particular environment, and is constructed using the tools and knowledge that mankind has accumulated.

Of particular interest to the present invention is the modern building structure, particularly that which is most commonly found in industrial and commercial settings. Many commercial and industrial buildings are constructed in areas which are subjected to substantial noise and traffic. For example, a commercial building in a downtown or urban area will quite commonly be located immediately adjacent to a busy street. Similarly, industrial buildings and complexes will almost always have very noisy areas such as semi-truck or rail loading docks, manufacturing areas housing loud equipment such as punch presses, grinders, lathes and other fabricating equipment, and other very noisy areas which may be located immediately adjacent to or nearby areas requiring relative sound isolation therefrom, including offices lunch rooms and other areas. Furthermore, many industrial and commercial buildings are located immediately adjacent or very near to mass transportation, such as railways, highways, and airports. Unfortunately, mass transportation is almost universally noisy. While the present invention will be described with such structures in mind, those skilled in the art will at once recognize that there exist other buildings and windows beyond those found in industrial and commercial settings to which the present invention will apply.

In order to provide an optimum environment for those persons active within the office spaces, lunch rooms, and other such spaces, the spaces must be relatively well sound-isolated, through a broad spectrum of sounds, to prevent the external noises from interfering with activity within the generally quieter spaces. Furthermore, in some instances, such as in the case of corporate board rooms and executive offices, it may also be very desirable to not only prevent the ingress of sound, but also isolate such rooms against an egress of sound as well.

In addition to sound isolation, thermal insulation is also a concern, particularly for the exteriors of buildings. Much energy is expended maintaining proper temperature and humidity control within a building, not only for human comfort but also for the preservation of documents, equipment and the like, all of which are important to many businesses and residences.

Early sound isolation was developed hand in hand with thermal insulation. The concept of an air-tight space, provided with sufficient thermal insulation such as foam or fiberglass, was thought to address both needs of sound and thermal barriers. In fact, materials such as fiberglass and rock wool provide superior thermal insulation and also superior sound isolation. As long as the sounds and thermal energy must pass through such materials, an excellent barrier is maintained. Consequently, much design development has gone into better sealing of spaces. Advanced elastomeric seals, including both gaskets around doors and other movable barriers, and relatively more permanent seals such as are formed by various caulks, have become quite sophisticated and effective at sealing up building spaces. However, modern buildings have become so air-tight that necessary movement of air is not always provided for. As but one example, in a modern multi-story building, the passage of an elevator from floor to floor, even with a vented elevator shaft, will still lead to a displacement of air at the floors, which will in turn require equalization. Similarly, the opening or closing of a swinging door to an otherwise sealed office or room will result in significant pressure increases or decreases within the office space. Yet, to vent the office space will undesirably couple the space to adjacent, potentially much more noisy environments. Furthermore, the desired thermal insulation will be by-passed by such vents.

In recognition of a need, prior artisans have combined window room ventilators with sound dampening, and also provided a sound dampening device for cylindrical air passages. U.S. Pat. No. 1,888,711 by Bourne, which is entitled "Window ventilator and silencer" and from which the teachings are incorporated herein by reference, describes a device for installing a window to provide blower-induced ventilation into or out of a room. It also has subdivided curved air passages between the blower and the room, with sound absorbing material on the passage surfaces. U.S. Pat. No. 4,751,980 by Harry DeVane, entitled "Sound attenuation apparatus," the teachings which are also incorporated herein by reference, describes an end-cap for a ventilation tube. The end cap consists of a mass of holes in thin plates stacked that mounts on a cylindrical airflow duct. Additional patents exemplary of the state of the art and the teachings of which are incorporated herein by reference include U.S. Pat. Nos. 977,413 by Matheson; 1,289,856 by Maxim; 1,511,920 by Tregillus; 1,655,195 by Newson; 1,922,152 by Bradbury; 4,362,223 by Meier Irmhild; 4,736,677 by Smith; 6,533,657 by Monson et al; 6,640,926 by Weinstein; and 6,648,750 by Wiseman.

Modern testing of windows comprises the generation of white noise adjacent to one surface of the window, and measuring of sound levels at various frequencies throughout the spectrum adjacent the opposite window surface, thereby identifying both a total transmission attenuation across the spectrum, and also identifying any existing resonance frequencies within the window structure that might be excited by the application of sound energy, and which will in turn couple such frequencies through the window.

While the plurality of baffles illustrated by Bourne may theoretically be designed to produce passageways that cancel broad ranges of noise, wherever a solid structure is utilized that is linked from one surface to the other, the entire structure or framework will have a particular resonant frequency which will couple sound at that frequency through from one face of a window to the other. Further, much like a bell or chime, the structure may even be induced to self-oscillate by the application of an impulse-type force, as is understood in the fields of physics and mechanical engineering. Unfortunately, window vents which rely upon an extrusion or a single solid structure may then couple sounds or even self-oscillate or ring upon application of sounds thereto. Finally, window vents of the prior art also tend not to factor in or provide for the desirable thermal insulation which is desired by most modern buildings. Consequently, the vents tend to be little more than a step backwards in time, effectively providing little more than a controlled opening through which both sound and thermal energy may pass.

SUMMARY OF THE INVENTION

Exemplary embodiments of the present invention solve inadequacies of the prior art by providing a combination of linear or continuous acoustic paths and air paths that diverge from the linear acoustic paths by abrupt directional changes midway along the acoustic paths. Each acoustic path terminates in an acoustic dampening tube which reduces the transmission of acoustic energy through the adjacent air path. By fabricating the acoustic and air paths from PVC or similar plastic tubing, thermal coupling and acoustic coupling through the tubing is minimal.

In a first manifestation, the invention is an air vent coupling a first building-enclosed space to a second space primarily isolated from the first building-enclosed space for air movement therebetween, while simultaneously limiting a transmission of sound and thermal energy through the air vent. A first support channel is provided which mechanically houses at least some portion of the air vent components in proper spacing relative to a building opening. A vent control is coupled to the first building-enclosed space and has an actuator which allows an occupant of the first building space to open or restrict air movement between the first building-enclosed space through the first support channel to the second space. A first segment of pipe couples air passing through the vent control to a first junction between first and second termini of a first acoustic pathway. The first acoustic pathway extends in two opposed directions from the first junction, at least immediately adjacent to the junction, and thereby defines an axis of the first acoustic pathway adjacent to the first junction. The first segment of pipe adjacent the junction is angularly offset from the axis of the first acoustic pathway. The first acoustic pathway extends in a first direction from the first junction to the first terminus and primarily blocks air from passing therethrough. The first acoustic pathway extends in a second direction opposed to the first direction to the second terminus and couples air passing through the first segment of pipe to the second space. At least one of the first segment of pipe and the acoustic pathway comprise plastic pipe, to simultaneously dampen acoustic energy and restrict thermal conduction through the pipe.

In a second manifestation, the invention is a building vent coupling a first fluid region to a second fluid region for fluid transmission therebetween, while simultaneously reducing a transmission of sound. The building vent has a ventilation gaseous exchange path formed of tubing. At least one junction connects more than two segments of tubing. At least one path of connected tubing couples the junction to the first fluid region. At least one path of connected tubing couples the junction to the second fluid region. At least one path of connected tubing extends from the junction to an acoustic terminus and has a length effective to reduce the transmission of at least one frequency of sound passing through the junction between the first and second fluid regions.

In a third manifestation, the invention is a vent coupling air within an enclosed building space to a second air space external to the enclosed building space for fluid transmission therebetween while simultaneously reducing a transmission of sound between the enclosed building space and the second air space. A first hollow support channel has an opening passing through a wall from an exterior of the first support channel to an interior thereof. A vent control is coupled through the first hollow support channel opening to allow a person within the enclosed building space to control an amount of fluid transmission. A first segment of plastic pipe is coupled with the vent control and coupled with a first one of at least two plastic pipe T-joints. A second segment of plastic pipe extends from the first one of the at least two plastic pipe T-joints perpendicular to the first segment and terminates at a pipe cap. The first one of the two plastic pipe T-joints is joined to a second one of the two plastic pipe T-joints by a third segment of plastic pipe. The third segment extends along a common longitudinal axis with the second segment and perpendicular to the first segment, and also passes through a wall of the first support channel from an interior to an exterior thereof, and passes through a wall of a second support channel from an exterior thereof to an interior. A fourth segment of plastic pipe extends from the second one of the at least two plastic pipe T-joints perpendicular to the third segment and terminates at a pipe cap. A fifth segment of plastic pipe extends from the second one of the at least two plastic pipe T-joints along a common longitudinal axis with the fourth segment and perpendicular to the third segment, and is coupled with the second air space.

OBJECTS OF THE INVENTION

A first object of the invention is to provide a vent which may be used to controllably vent the interior of a generally enclosed space to the exterior, while providing minimal sound and thermal coupling therebetween. A second object of the invention is to provide such a vent in an existing passageway through a wall separating the interior from the exterior. Another object of the present invention is to incorporate standard vent closures and commonly manufactured components wherever possible, to reduce tooling and production costs. A further object of the invention is to enable fabrication to varying window sizes using the same aforementioned standard and commonly manufactured components. Yet another object of the present invention is to enable acoustic tuning of a vent to meet the needs for a specific application, while achieving the remaining objectives.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
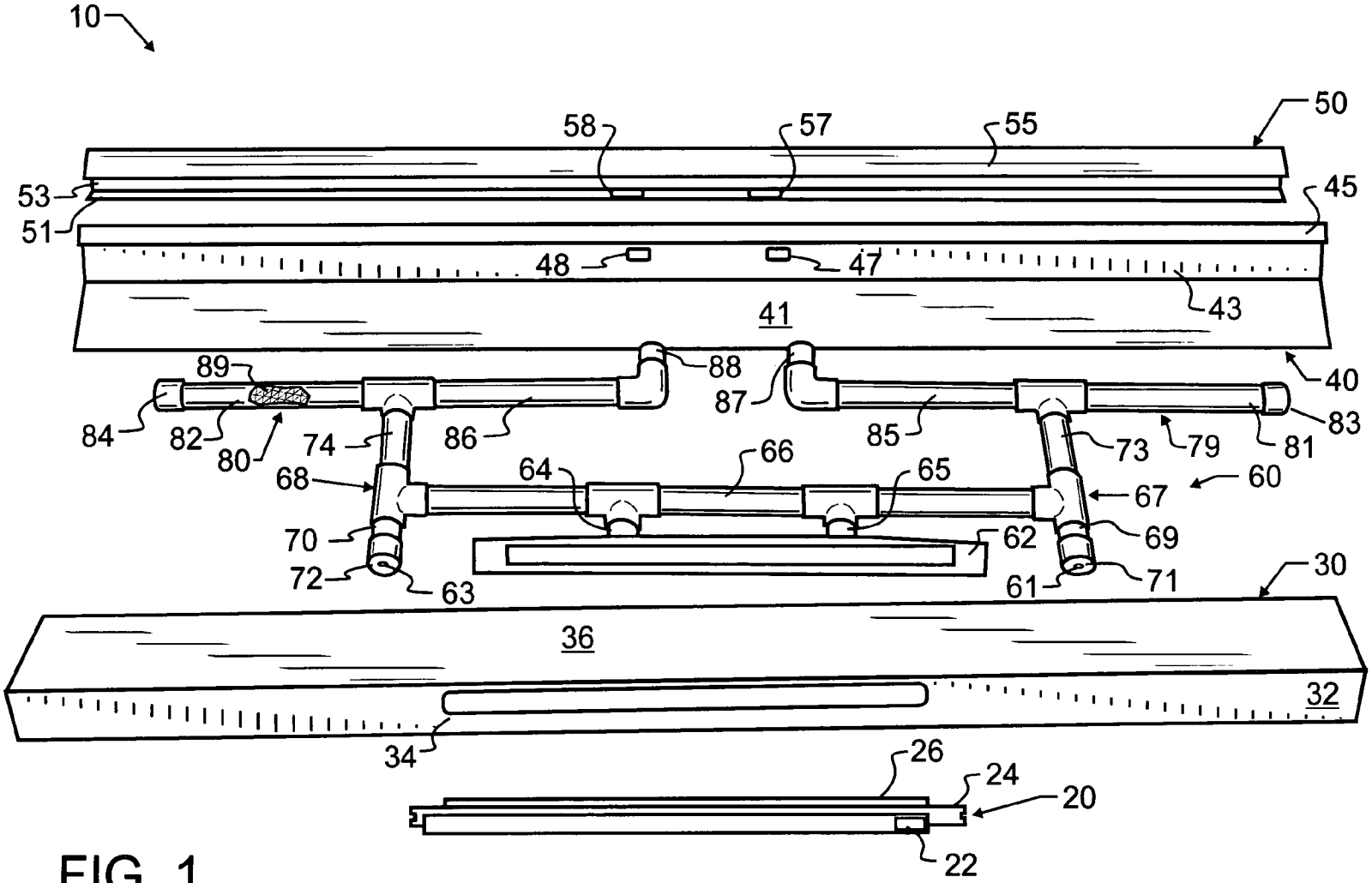
FIG. 1 illustrates a preferred embodiment trickle vent designed in accord with the teachings of the present invention from an exploded and projected view, with a few of the framing components removed for illustrative purposes.

Manifested in the preferred embodiment, the present invention provides a trickle vent which couples air from one space with another, while not significantly coupling either sound or thermal energy therebetween. The preferred embodiment trickle vent 10 comprises five major components. These include a vent control 20, first structural housing 30, second structural housing 40, exterior cover 50, and sound and thermally dampening conduit 60.

Vent control 20 in the preferred embodiment is a commercially available vent control such as is illustrated for exemplary purposes in one or more of the following U.S. Pat. Nos. 4,727,797; 4,736,677; 5,244,434; 5,344,366; 5,518,452; 5,558,574; 5,702,297; 5,746,654; 5,769,706; 6,048,266; 6,558,247; and 6,648,750; the relevant teachings of each which are incorporated herein by reference. While such vent control is preferred, owing to the ready availability and added capability provided therewith, it will be recognized by those skilled in the art that similar vent controls are not essential to the operation of the present invention, and may, in fact, be omitted entirely. Nevertheless, such controls are preferred and incorporated into the present preferred embodiment trickle vent 10.

Vent 20 is typically comprised of an interior surface having an actuator 22, which is typically moved either left or right relative to frame member 24 and exterior face 26 to cause vent control 20 to either open or close and thereby either allow or restrict passage of gases through frame member 24. Frame member 24 may be coupled to a face 32 of a first support tube 30 adjacent an opening 34. Most preferably, exterior face 26 passes through opening 34, and is in turn coupled to funnel 62. Funnel 62 will control the flow of any gases passing through framing member 24 into tubes 64, 65. These tubes are arranged to extend some direction through the building wall between interior and exterior, but only a portion thereof.

Tubes 64, 65 are just two of a large numbers of tubes 64-88 used in the present invention. For the purposes of the present disclosure, tubes will be defined herein to mean longitudinally extensive bodies having a hollow or open center which is generally circumscribed by a wall which is relatively small in thickness when compared to the longitudinal length of the tube. While round tubes have been illustrated herein for the preferred embodiment, it will be understood that such tubes are not required by the present invention and that a multitude of other geometries could be used. For exemplary purposes only, and not limited thereto, the tubes 64-88 of the present invention could be square, triangular, oval or any other suitable shapes. However, the use of a tube having a circular cross-section permits extrusion for relatively low cost, and round tubes, which are quite commonly sold as smaller diameter pipe, are readily available in large quantity without any special tooling costs or purchases required.

Tubes 64 and 65 may be coupled into tube 66 using common T-couplers, or any other suitable connection. Acoustic foam is preferably provided within tube 66 between tubes 64 and 65. Tube 66 runs within the general plane of the wall of the building, and couples at distal ends through perpendicular T-couplers to a point intermediate to each end of tubes 67, 68. Consequently, tube 67 is subdivided into a segment 69 which extends a small distance in a direction perpendicular to tube 66, and terminates in an end cap 71. For reasons to be discussed herein below, tube 69 may optionally be filled with acoustically dampening material, and end cap 71 may optionally be provided with a small hole 61 passing directly from an air-filled interior of tube 69 to a point exterior of tubes 64-88. Similarly, tube 68 is subdivided into a tube 70 which extends a small distance in a direction perpendicular to tube 66, and terminates in an end cap 72. Tube 70 may optionally be filled with acoustically dampening material, and end cap 72 may optionally be provided with a small hole 63 passing directly from an air-filled interior of tube 70 to a point exterior of tubes 64-88. Extending from tube 66 and along a pathway coupling vent control 20 to an exterior air region are additional tubes 73, 74. Much like tube 66, each of these tubes 73, 74 will also terminate through a T-coupling. Tube 73 couples to tube 79 at some midpoint there along between ends, and tube 74 couples to tube 80 at some midpoint between ends. This coupling divides tube 79 into a tube 81 which simply terminates at end cap 83, and tube 85, which continues along the pathway from inlet to outlet. Tube 81 may optionally be filled with acoustically dampening material, and end cap 83 may either be solid or be provided with a small through hole similar to holes 61, 63. Likewise, tube 80 is divided into a tube 82 which simply terminates at end cap 84, and tube 86, which continues along the pathway from inlet to outlet. Tube 82 may optionally be filled with acoustically dampening material illustrated by cut-away view at 89, and end cap 84 may either be solid or be provided with a small through hole similar to holes 61, 63. Finally, tubes 79 and 80 are coupled through perpendicular extensions 87 and 88, respectively, to a sheltered vent space formed by exterior cap 50.

Figure 2:
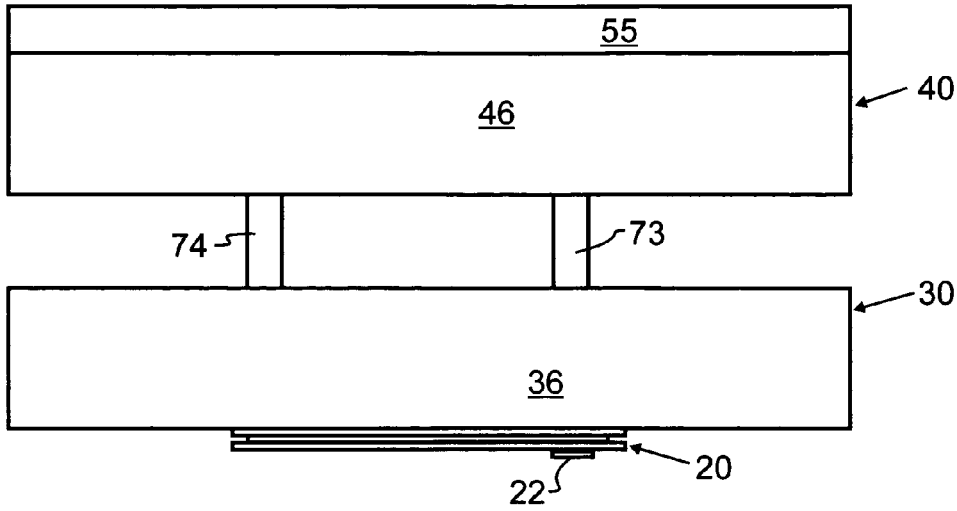
FIG. 2 illustrates the preferred embodiment trickle vent of FIG. 1 from a top, assembled, plan view.

In the preferred embodiment trickle vent 10, tubes 73, 74 pass from within first support tube 30 through a small gap to second support tube 40, as is best visible from top view in FIG. 2. Support tubes 30 and 40 provide mechanical separation and enclosure between a window and the supporting wall, while still permitting conduit 60 to pass from a building interior to a building exterior, or from an enclosed room to a space exterior, or through other similar barrier.

Figure 3:
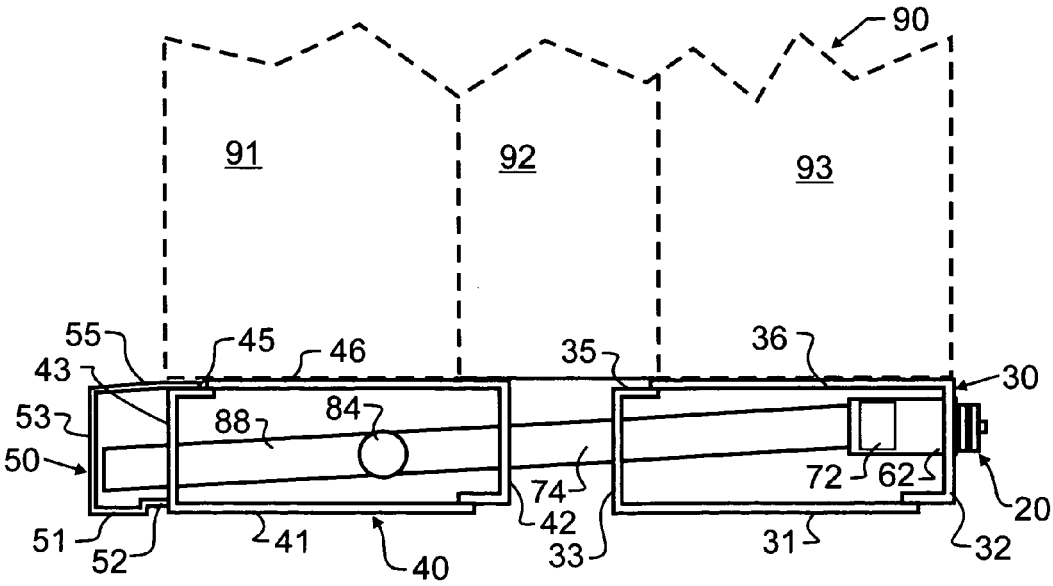
FIG. 3 illustrates the preferred embodiment trickle vent of FIG. 1 from a side, assembled, plan view.

As FIG. 3 illustrates somewhat schematically, a typical prior art multiple glazed window 90 may have an exterior section 91, interior section 93, and a mechanical coupling 92 between sections 91, 93. Mechanical coupling 92 may commonly form at least a thermal barrier, and may alternatively or also reduce acoustic coupling between sections 91, 93. Adjacent the base, top, or along the side of window 90, trickle vent 10 will seal to an adjacent opening in the wall at both support tubes 30 and 40. Nevertheless, a thermal and acoustic break is provided therebetween, and is solely bridged by tubes 73, 74. As FIG. 3 further illustrates, in the preferred embodiment, support tubes 30, 40 are at the base of a window, and so exterior cap 50 may be provided with a small gap or holes 57, 58 passing downward and to the outside of the building. By orienting the opening downward, any rain, precipitation or other foreign matter will not to be coupled into conduit 60. Where desired or appropriate, and as is known in the art, additional measures may be taken to block out insects or other creatures, such as but not limited to the provision of screening. Exterior cap 50 has a top surface 55 designed to mate flush with surface 46, an exterior vertical wall 53, and a base 51 terminating in caulk groove 52.

The portions of support tubes 30, 40 which are omitted from FIG. 1 are visible in FIG. 3. In the preferred embodiment, support tubes 30, 40 are each preferably fabricated from two main extrusions. One extrusion will have surfaces 31, 41 adjacent the bottom of the window opening, vertical walls 33, 43, and small steps 35, 45. The second portion forms the remaining walls to create the rectangular geometries seen in FIG. 3, and so will include vertical walls 32, 42 and horizontal top surfaces 36, 46. The two piece supports 30, 40 are preferable to a single extrusion, since conduit 60 may be fully assembled prior to placing within support tubes 30, 40, simply by setting assembled conduit 60 into only one half of supports 30, 40. Most preferably, such assembly will include appropriate alignment with through holes, such as the alignment of tubes 87, 88 with holes 47, 48, respectively. Likewise, vent control 20 will need to pass through hole 34 and couple to funnel 62. A seal can be made between tubes and holes with the introduction of expanding polyurethane foam or other suitable sealant. Most preferably, the remaining halves will simply be slipped down around conduit 60. In order to enable such assembly, vertical wall 33 must have slots cut therein entirely through step 35 and partially down vertical wall 33, so that tubes 73, 74 will fit within the slots during installation. Similar slots are preferably provided in vertical wall 42 and extending downward. Consequently, the assembly of the components illustrated in FIG. 1 will be made first, and then the two remaining generally L-cross-section extrusions will be slipped into place and locked to form supports 30, 40. At this time, the remaining passages of tubes 73, 74 through supports 30, 40 may be sealed with polyurethane foam. In addition, and where desired, additional polyurethane foam or acoustic foam may be provided within open spaces on the interior of supports 30, 40. Such additional foam will act as an additional sound and thermal barrier which may, in some instances, be desirable. While not illustrated, additional blocks or other structural support may also be provided within supports 30, 40 to prevent collapse or bolster load support capability.

From a user's perspective, trickle vent 10 is very easy to use. The user must simply slide actuator 22 left or right to control the opening or closing of the vent. At the time of design of conduit 60, however, there is far more capability that may readily be achieved than will ever be immediately apparent to the user. More particularly, each T-coupling, such as between tubes 74, 82, and 86, will form an acoustic dampener which may be tuned to a particular set of auditory frequencies. For example, very high frequencies tend to be very directional, and do not easily change direction or pass through curves. Consequently, high frequency external sounds that pass into tube 80 will primarily pass into dead-end tube 82. Some of the sound energy will be absorbed therein, particularly where acoustical material is packed within tube 82. Some sound energy will be reflected by end-cap 84 back towards tube 86. Where there is appropriate length for phase cancellation, a number of frequencies may be canceled simply by reflection off of end cap 84. The use of two or more T-couplings in each acoustic pathway permits various segments to be fabricated from different lengths, such as tube 70 being significantly shorter than tube 82. Such length variations may assist in phase cancellation of a broader range of frequencies than would be possible with only a single dead-end tube. Furthermore, more than two dead-end tubes may be provided in a single trickle vent air pathway, with the only limit being the amount of available space and cost which can be tolerated. As should be apparent then, the lengths of and numbers of dead-end tubes can be used to acoustically tune the trickle vent for most effective acoustic cancellation for a particular application. Finally, the use of holes 61, 63 in end caps; the use of materials selected for optimal acoustic and thermal isolation, such as the use of PVC or other plastic or like tubing which is known to provide either or both of acoustic and thermal isolation; and the use of acoustic foam such as 89 will serve as tools for a designer to complete the acoustic and thermal isolation desired in the present invention.

While impossible to readily illustrate, those skilled in the art will also recognize the opportunity to provide a slight tilt within conduit 60 and the individual tubes therein to evoke drainage of any condensate. Most commonly, this tilt will extend from a high spot adjacent vent control 20 to a low point adjacent ends 87, 88. If tube 66 is split, it will also be possible to tilt symmetrical halves to keep moisture from accumulating in tubes 81, 82, for example, by making cap 83 also higher than end 87.

While the tubes that form conduit 60 are illustrated as being linear, it is further contemplated herein that such tubes may be curved as desired. For example, tube 82 might in one conceived-of alternative extend adjacent to tubes 74 and 86 in the direction shown, but may curve in a gentle arc upward therefrom to encourage drainage. So long as such changes of direction are not abrupt, they will not adversely effect the performance of the preferred embodiment, and may be used, for exemplary purposes only and not limited thereto, to assist with drainage or to facilitate location of tubing within a crowded space.

While the foregoing details are what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

I claim:

1. An air vent coupling a first building-enclosed space to a second space primarily isolated from said first building-enclosed space for air movement therebetween, while simultaneously limiting a transmission of sound and thermal energy through said air vent, comprising:

a first support channel;

a vent control coupled to said first building-enclosed space and having an actuator which allows an occupant of said first building space to open or restrict said air movement between said first building-enclosed space through said first support channel to said second space;

a first segment of pipe coupling air passing through said vent control to a first junction between first and second termini of a first acoustic pathway, said first acoustic pathway extending in two opposed directions from said first junction immediately adjacent to said first junction and thereby defining an axis of said first acoustic pathway adjacent to said first junction, said first segment of pipe adjacent said first junction angularly offset from said axis of said first acoustic pathway;

said first acoustic pathway extending in a first direction from said first junction to said first terminus and primarily blocking air from passing therethrough;

said first acoustic pathway extending in a second direction opposed to said first direction to said second terminus and coupling air passing through said first segment of pipe to said second space;

at least one of said first segment of pipe and said acoustic pathway comprising plastic pipe to simultaneously dampen acoustic energy and restrict thermal conduction through said pipe; and a second acoustic pathway coupled through an air passage with said first acoustic pathway at a second junction, said second acoustic pathway extending in two opposed directions from said second function immediately adjacent to said second junction and thereby defining an axis of said second acoustic pathway adjacent to said second junction, said air passage adjacent said second junction angularly offset from said axis of said first acoustic pathway.

2. The air vent of claim 1 wherein both said first segment of pipe and said first acoustic pathway comprise plastic pipe.

3. The air vent of claim 1 wherein said first junction comprises a T-coupler joining said first segment of pipe to a second and a third segment of pipe, said second and third segments of pipe axially aligned at said first junction to define said axis of said first acoustic pathway.

4. The air vent of claim 1 wherein said air passage comprises said first acoustic pathway extending in said second direction.

5. The air vent of claim 1 further comprising acoustic foam within said first acoustic pathway.

6. The air vent of claim 1 wherein said first terminus further comprises a cap.

7. The air vent of claim 6 wherein said cap completely seals said first terminus and prevents air from passing therethrough.

8. The air vent of claim 6 wherein said cap has a vent hole formed centrally therein and permits some air to pass therethrough.

9. A vent coupling air within an enclosed building space to a second air space external to said enclosed building space for fluid transmission therebetween while simultaneously reducing a transmission of sound between said enclosed building space and said second air space, comprising:

a first hollow support channel having an opening passing through a wall from an exterior of said first support channel to an interior thereof;

a vent control coupled through said first hollow support channel opening to allow a person within said enclosed building space to control an amount of said fluid transmission;

a first segment of plastic pipe coupled with said vent control and coupled with a first one of at least two plastic pipe T-joints;

a second segment of plastic pipe extending from said first one of said at least two plastic pipe T-joints perpendicular to said first segment and terminating at a pipe cap;

said first one of said two plastic pipe T-joints joined to a second one of said two plastic pipe T-joints by a third segment of plastic pipe installed between said first pair of two plastic pipe T-joints, said third segment extending along a common longitudinal axis with said second segment and perpendicular to said first segment and said third segment passing through a wall of said first support channel from an interior of said first support channel to an exterior thereof and passing through a wall of a second support channel from an exterior thereof to an interior of said second support channel;

a fourth segment of plastic pipe extending from said second one of said at least two plastic pipe T-joints perpendicular to said third segment and terminating at a pipe cap; and a fifth segment of plastic pipe extending from said second one of said at least two plastic pipe T-joints along a common longitudinal axis with said fourth segment and perpendicular to said third segment, and coupled with said second air space.

10. The vent of claim 9 wherein said second and fourth segments of plastic pipe are of different lengths.

* * * * *